United States Patent [19]

McClish

[11] Patent Number: 4,911,054

[45] Date of Patent: Mar. 27, 1990

[54] NOISE-CANCELLING PICKUP FOR STRINGED INSTRUMENTS

[76] Inventor: Richard E. D. McClish, 2200 Chapdelaine, Apt. 1203, Ste-Foy, Quebec, Canada, GIV-4G8

[21] Appl. No.: 355,847

[22] Filed: May 16, 1989

Related U.S. Application Data

[63] Continuation of Ser. No. 184,103, Apr. 20, 1988, abandoned.

[51] Int. Cl.[4] ..... G10H 3/18

[52] U.S. Cl. ..... 84/725; 84/727

[58] Field of Search ..... 84/1.04, 1.06, 1.14–1.16, 84/DIG. 24

[56] References Cited

U.S. PATENT DOCUMENTS

| | | | |
|---|---|---|---|
| 3,073,202 | 1/1963 | Evans | 84/1.14 |
| 3,137,754 | 6/1964 | Evans | 84/1.16 |
| 3,453,920 | 7/1969 | Scherer | 84/1.16 |
| 3,712,951 | 1/1973 | Rickard | 84/1.14 |
| 4,314,495 | 2/1982 | Baggs | 84/1.16 |
| 4,491,051 | 1/1985 | Barcus | 84/1.16 |
| 4,584,923 | 4/1986 | Minnick | 84/1.16 X |

*Primary Examiner*—Stanley J. Witkowski

[57] ABSTRACT

A noise-cancelling pickup for a stringed instrument uses two transducers to monitor different forces exerted by a vibratable string under tension. The first transducer is responsive to the music vibrations of the vibrating portion of the string but it is also responsive to variations of the string tension which are not related to the music vibrations of the string. The second transducer is mainly subjected to the variations of the string tension which are not related to the desirable music vibrations. The signals from the transducers are combined in and out-of-phase manner to produce a joint signal in which the spurious components corresponding to the variations of the string tension are significantly attenuated and possibly eliminated.

19 Claims, 4 Drawing Sheets

NOISE-CANCELLING PICKUP FOR STRINGED INSTRUMENTS

This application is a continuation of application Ser. No. 184,103 filed Apr. 20, 1988 and now abandoned.

TECHNICAL FIELD

The present invention relates to stringed musical instruments and more specifically to electromechanical transducers therefor capable of rejecting unwanted vibrations while remaining sensitive to desirable string vibrations.

BACKGROUND ART

Electromechanical transducers are commonly used in connection with stringed musical instruments, especially with acoustic guitars. U.S. Pat. Nos. 3,073,203 issued to Evans and 3,712,951 issued to Rickard are typical examples of prior art bridge pickups where each string contacts a separate transducer. String contacting transducers usually have a wide frequency response and are usually maximally responsive in the vertical plane; that is, in a plane perpendicular to that of the strings and perpendicular to the plane of the fingerboard of the instrument.

A first problem exists, when a string is stimulated near a string contacting transducer, that any resulting transient is over-emphasized in the pickup signal. A second problem exists when pickups which are maximally responsive in the vertical plane are used in a stringed instrument, that body noises and body resonances are over-emphasized in the pickup signal when the resonating body reacts against a transducer contacting a string. This may lead to acoustic feedback when the instrument is amplified and reproduced through loudspeakers. A third problem exists when such vertically responsive pickups are used in a stringed instrument having a vibrato tailpiece or a tremolo-bridge, that the important changes in the string tension caused by the operation of such devices produce large offsets or spurious vibrations in the transducer signal which are difficult if not impossible to filter out without significantly reducing the sensitivity of the pickup to desirable string vibrations.

It is possible to reverse the polarity of every other string transducer in the pickups of the inventions mentioned earlier, in order to cancel the effects of common body vibrations in the sum of the signals. U.S. Pat. No. 3,137,754 issued to Evans describes such a pickup. U.S. Pat. No. 4,314,495 issued to Baggs and U.S. Pat. No. 4,491,051 issued to Barcus are further examples of bridge pickup designs based on this concept, but none of the above-mentioned pickups produce separate noise-free string signals nor can they be used to reduce the adverse proximity effect caused by nearby string stimulation.

In U.S. Pat. No. 3,137,754 Evans tentatively suggests that an idle transducer located near a string contacting transducer may serve to cancel common body vibrations but this method fails to perform over the required bandwith, especially in the low frequencies where virtually no effect is produced.

U.S. Pat. No. 3,453,920 issued to Scherer describes a noise-cancelling string transducer having minimum sensitivity in the vertical plane. The transducer is quite insensitive to finger and body noises but when such a transducer is used in a fretted instrument such as a guitar, and the transducer signal is reproduced by an amplifier, the sound of the fretted notes is significantly and displeasingly different from the sound of the open strings. This unacceptable tone distortion is mostly noticeable when the vibrating string is displaced laterally on the contacting fret in such instances as bending the string or performing a vibrato. It is generally agreed to in the prior art that a guitar string transducer should have high sensitivity in the vertical plane and preferably in all planes of vibration of the string. This would seem to foreclose the possibility for a string transducer to have a high sensitivity to the desirable string vibrations and minimum sensitivity to undesirable body noises and resonances, to transducer proximity effect and to changes in the string tension.

It is therefore a broad object of the present invention to provide an electromechanical pickup for a stringed instrument capable of monitoring the desirable vibrations of one or more contacting strings while rejecting undesirable vibrations occurring in planes possibly including the plane of the monitored desirable vibrations.

It is a more specific object of the present invention to provide a contact pickup for an instrument string which rejects undesirable bridge vibration frequencies while remaining normally sensitive to the corresponding frequencies in the desirable string vibrations.

It is another object of the present invention to provide a noise-cancelling pickup for use in a guitar or similar instrument having a vibrato tailpiece or a tremolo-bridge.

It is a further object of the present invention to provide a bridge pickup which is less sensitive to nearby string stimulation than prior art devices.

It is a still further object of the present invention to produce this noise-cancelling effect possibly without using signal filtering circuitry.

SUMMARY OF THE INVENTION

According to the invention, a stringed instrument has at least one vibratable string under tension which contacts a first transducer acting as the bridge or mounted on the bridge of the instrument. A "break-angle" is formed over the first transducer by the contacting string. This break-angle enables the vibrating string to remain in contact with the first transducer. The first transducer, acting to define one end of the vibrating portion of the string, monitors the desirable string vibrations of the contacting string. A compressive force is exerted on the first transducer by the contacting string even when the string does not vibrate. This force or pressure is a function of the tension in the string and also a function of the amount of break-angle made by the string as it passes over the first transducer; the force is exerted in the direction of the bisector of the break-angle.

If either the amount of break-angle or the amount of tension in the contacting string is varied, there will be a corresponding change in the pressure exerted on the first transducer. If the first transducer is sensitive in the plane of these pressure changes, it will convert them into an electrical signal as if these pressure changes were desirable string vibrations. When the contacting string vibrates to produce a musical tone, the signal from the first transducer will then contain components caused by the desirable string vibrations mixed with the components resulting from the transduction of the aforementioned pressure changes. This condition is undesirable when the components of the signal resulting from these pressure changes are extraneous to those resulting from the desirable string vibrations.

The undesirable components of the signal from the first transducer may not be removeable by filtering without adversely altering the sensitivity of the first transducer to the desirable string vibrations. In order to obtain the desired reduction of the unwanted portion of the pickup signal, a second transducer is made to produce a signal corresponding preferably exactly to the unwanted components of the signal from the first transducer. This second signal is then mixed with the signal from the first transducer in the required out-of-phase manner and in the proper proportions to obtain a joint signal in which these undesirable components are preferably cancelled.

The joint signal preferably contains only the components of the signal from the first transducer which are caused by the desirable string vibrations. It is therefore preferable for the signal from the second transducer to contain a minimum of components which would tend to cancel the desirable components of the signal from the first transducer. The signal from the second transducer is also preferably free from spurious frequencies and noises which cannot be cancelled in the joint signal. If the signal from the second transducer contains a small amount of desirable signal cancelling components, this is of small consequence and the sound of the pickup will still be determined mainly by the performance characteristics of the first transducer.

The second transducer may be of a different construction or of a different type than the first transducer and still be used to cancel the undesirable components of the signal from the first transducer. The second transducer may be subjected to the tension of a string contacted by the first transducer or to a proportional or inversely proportional force related thereto. The second transducer may monitor the position of a portion of the instrument which moves to create a change in the tension of a string or which is moved as a result of a change in the string tension. The second transducer is preferably not significantly subjected to extraneous string vibrations, such as those of a string which is not contacted by the first transducer, in order to avoid introducing large extraneous string signal components which cannot be cancelled in the joint signal.

If a second transducer is subjected to undesirable vibrations which commonly affect a plurality of in-phase first transducers while it is not significantly subjected to any desirable string vibrations, it may be used to produce a plurality of identical signals which may be combined respectively in an out-of-phase manner with the discrete signals from the first transducers subjected to the common undesirable vibrations, to produce a plurality of separate string signals in which the undesirable components are significantly reduced or cancelled.

In a first embodiment, a plurality of pickups according to the present invention are installed in the bridge of an acoustic-electric guitar in order to produce separate noise-free string signals. The sensitivity of each pickup to wolf tones, body noises and acoustic feedback is substantially reduced. Both transducers of each pickup contact a common string at different points along its length. The transducers of each pickup are similar in construction but of opposite polarity and they are connected in parallel to produce a joint signal.

In a second embodiment which is a variation of the first embodiment, both transducers of each pickup contact a common string anchored near the second transducer, and they are mounted near one another on a tremolo-bridge in order to produce a separate string signal in which the undesirable effects of the bridge movements are significantly reduced and possibly cancelled.

In a third embodiment, a single second transducer serves to cancel the common undesirable components in the separate string signal from each of an array of first transducers mounted on a tremolo-bridge. The second transducer is monitoring the movements of the bridge. Separate noise-free string signals are thereby produced.

In a fourth embodiment, the second transducer is a strain gauge under tension located remotely from the first transducer.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings wherein.

DETAILED DESCRIPTION OF THE PREFERRED EMBODIMENTS

Figure 1:
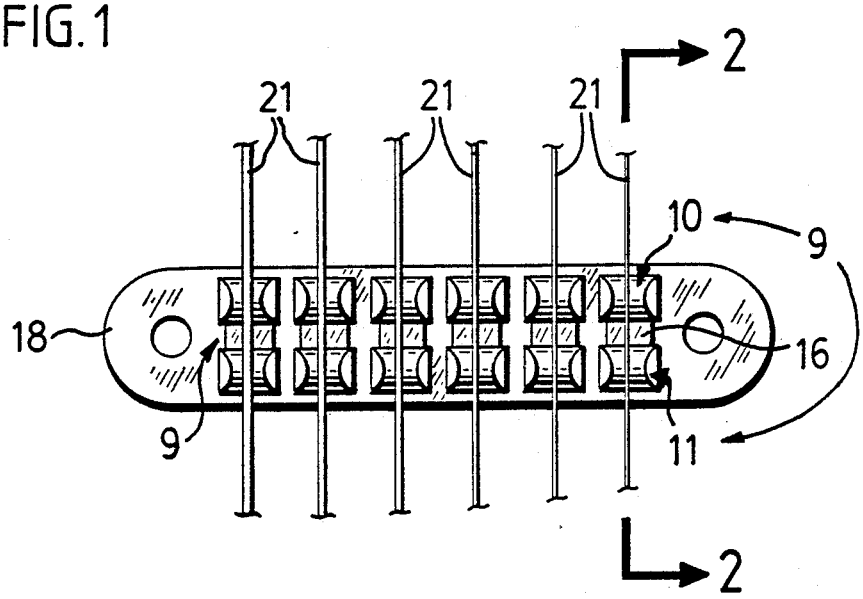
FIG. 1 is a plan view of a first embodiment of the present invention in the bridge of an acoustic-electric guitar.
Figure 2:
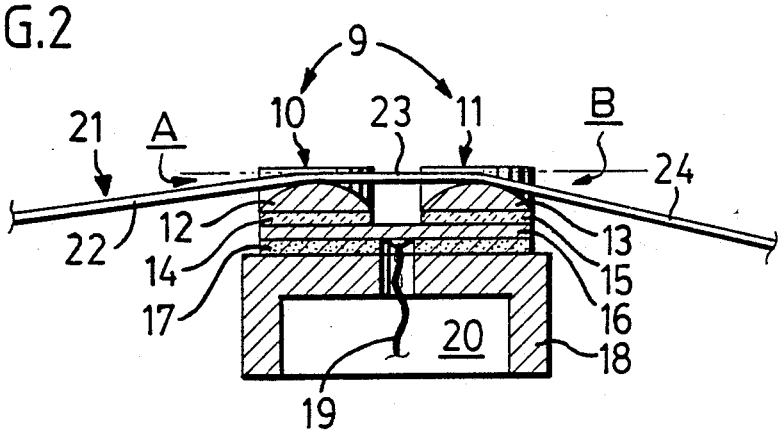
FIG. 2 is a side section view of one of the pickups of FIG. 1.
Figure 3:
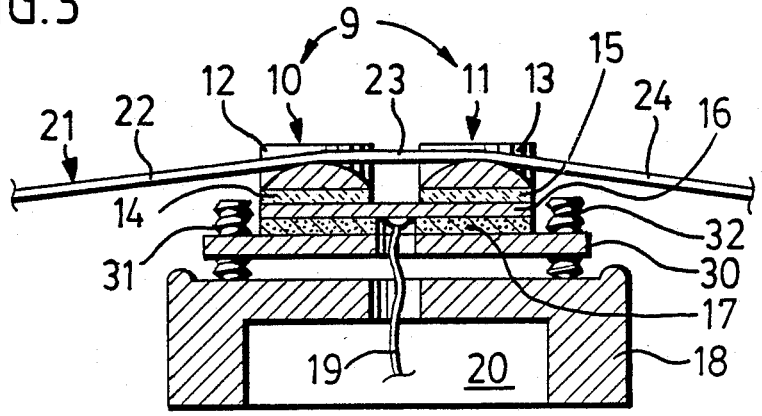
FIG. 3 is a side section view of a pickup similar to that of FIG. 2 but with height adjustment for each transducer.

FIGS. 1–3 of the drawings illustrate a first embodiment of the invention in the bridge 18 of a guitar. The instrument has a plurality of strings 21, each of which contacts a pickup 9 composed of transducers 10 and 11 disposed on the bridge 18 in a manner to contact different points along the length of the string 21. The pressure transducers 10 and 11 are of opposite polarity. That is, they respectively tend to produce signals of opposite polarity in response to a given pressure simultaneously applied to both transducers.

The first transducer 10 comprises a string support 12 and a pressure transducer element 14. In a guitar, the first transducer 10 should have a high sensitivity at least in a plane approximately perpendicular to the frets of the instrument and preferably in all planes of vibration of the string 21. The first transducer 10 defines one end of the vibrating portion 22 of the string 21. A first break-angle A is made by the string 21 as it passes over the first transducer 10. The first break-angle A renders the first transducer 10 sensitive to changes in the tension of the string 21.

The second transducer 11 comprises a string support 13 and a pressure transducer element 15. The second transducer 11 is not subjected to the desirable string vibrations occurring in the vibrating portion 22 of the string 21 to the same degree than the first transducer 10. The second transducer 11 contacts portions 23 and 24 of the string 21. Since portions 22 and 23 are adjacent portions of the same string 21, a small amount of desirable vibrations may be present in the portion 23 by virtue of the possible pivotal movements of the string 21 over the first transducer 10. The second transducer 11 is typically not subjected to these desirable vibrations to a significant degree. A second break-angle B is made by the string 21 as it passes over the second transducer 11. This second break-angle B renders the second transducer 11 sensitive to changes in the tension of the string 21.

When a change occurs in the tension of the string 21, a corresponding pressure change occurs simultaneously in both transducers 10 and 11. Since the transducers 10 and 11 are of opposite polarity, the effects of the changes in the tension of the string 21 and all vibrations tending to affect both transducers 10 and 11 in an in-phase manner are significantly reduced in the joint response of the transducers 10 and 11.

The transducers 10 and 11 are electrically connected together so that their joint response may be obtained. For this purpose, a common supporting conductor element 16 is used to provide an electrical connection between the contacting electrodes of the pressure transducer elements 14 and 15. A lead wire 19 carries the pickup signal from the conductor element 16 to utilisation means. In order to complete the electrical circuit connecting the transducers 10 and 11 of the pickup 9 to utilisation means, the remaining electrodes of the pressure transducer elements 14 and 15 which respectively contact the string supports 12 and 13 are grounded. For this purpose, the string supports 12 and 13 are either constructed of an electrically conductive material or covered with an electrically conductive coating, and grounded. The string 21 is electrically conductive and provides ground to the string supports 12 and 13. This arrangement of parts tends to reduce the mass of the string supports by eliminating the grounding conductors normally required with a non-conductive string. It also simplifies the wiring of the pickup 9 and thus helps to reduce its cost.

Although it is not essential to the pickup function, the bridge 18 is preferably electrically conductive or covered with an electrically conductive coating and grounded. This grounded surface below the pickup 9 tends to act as a shield against interference fields. An insulator element 17 is used to separate the conductor element 16 electrically from the conductive bridge 18.

It is preferable that all materials used in the construction of the pickup 9 and of the bridge 18 be hard and incompressible so that the full force of the string vibrations will distort the pressure transducer elements 14 and 15, and thus produce the strongest possible signals in response to such vibrations. A great degree of hardness in the materials of the pickup 9 also helps to increase the decay time of the string vibrations, especially in the high frequencies.

In FIG. 3, both transducers 10 and 11 of the pickup 9 lie on a supporting plate 30 which can be independently adjusted in height and inclination by means of height adjusting screws 31 and 32. This allows the ratio of the break-angles A and B made by the string 21 over the respective transducers 10 and 11 to be optimized for maximum cancellation of both the unwanted vibrations and the changes in the tension of the string 21, while providing individual string height adjustment.

Figure 4:
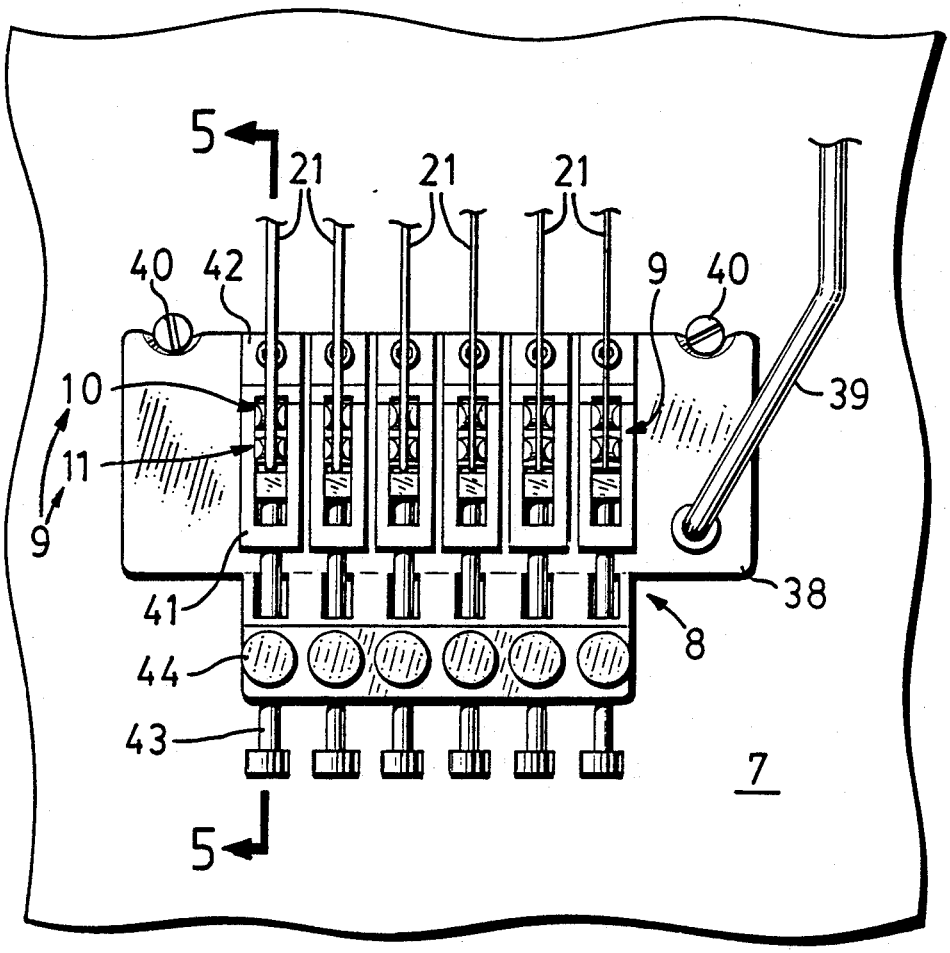
FIG. 4 is a plan view of a second embodiment of the present invention in the tremolo-bridge of a solid-body guitar.
Figure 5:
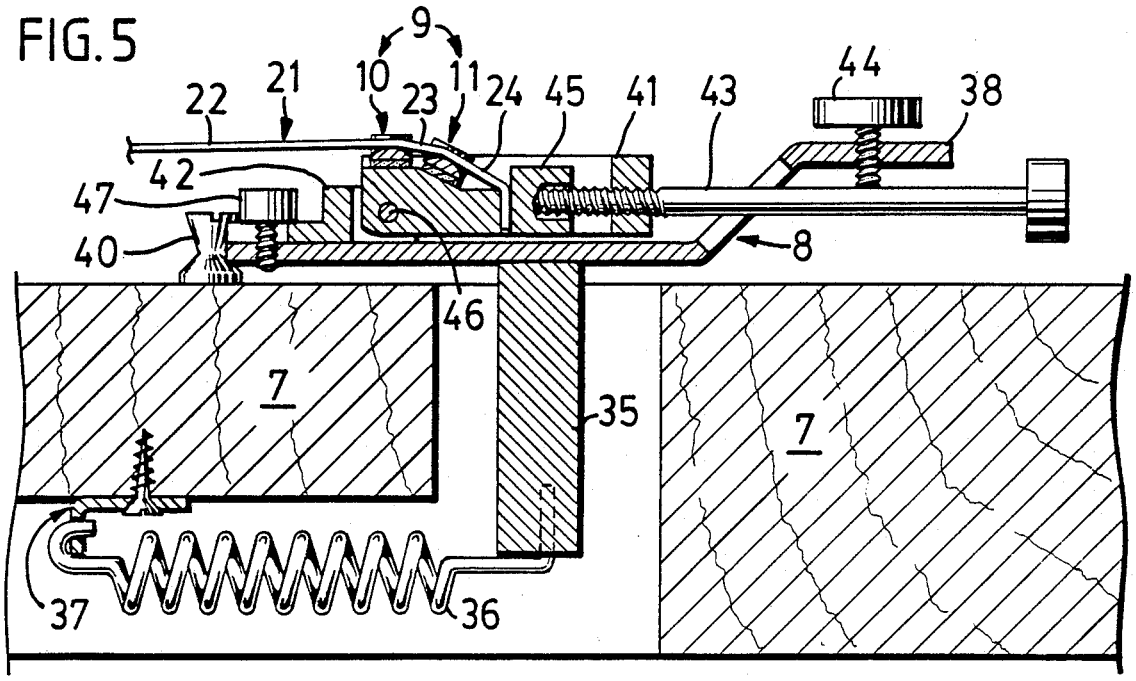
FIG. 5 is a side section view of one of the pickups of FIG. 4.

FIGS. 4 and 5 illustrate a second embodiment of the present invention in a tremolo-bridge. This type of bridge is a self-centering string-tension varying device enabling the musician to alter the pitch of single notes or entire chords by moving a controlling arm 39.

A bridge block 35 is fixed to the underside of a bridge plate 38. The bridge plate 38 supports a plurality of string anchoring blocks 41, each of which is attached to the plate 38 by means of a hinge pin 46, a hinge block 42 and a securing screw 47. Each hinge block 42 can slide within limits on the bridge plate 38 and thus provide intonation adjustment for the corresponding string 21. Each string anchoring block 41 supports a pickup 9 comprising a first transducer 10 and a second transducer 11. The first transducer 10 is subjected to the desirable string vibrations of the vibrating portion 22 of the string 21 while the second transducer 11 responds mainly to changes in the tension of the string 21. Portion 24 of the string 21 is anchored at a short distance from the pickup 9 in order to reduce the magnitude of the shear forces exerted on the transducers 10 and 11 when the tension of the contacting string 21 is varied. A pressure block 45 transfers the string holding pressure from the string anchoring screw 43 to the portion 24 of the string 21 compressed against the string anchoring block 41. Keeping portion 24 of the string 21 as short as possible significantly reduces the amount of spurious vibrations which may occur in that portion 24 of the string 21. A fine-tuning screw 44 passing through the bridge plate 38 serves to vary the tension in the string 21 by changing the orientation of the string anchoring block 41 around the hinge pin 46. The bridge plate 38 is pressed sideways against two fulcrum screws 40 by the combined tensions of the strings 21 and of the retaining spring 36. The two fulcrum screws 40 anchored in the body 7 of the instrument serve as height adjusters for the bridge plate 38 so that the action of the instrument may be set to the musician's taste. One end of the retaining spring 36 is anchored in the bridge block 35 which is solidary of the bridge plate 38, while the other end of the retaining spring 36 is held by a retaining plate 37 solidary of the body 7 of the instrument. By raising and lowering the controlling arm 39, the entire tremolo-bridge 8 is rocked on the fulcrum screws 40 about a center position, changing the tension of the strings 21 and thus altering their pitch in a predictable manner when the string 21 vibrate.

The strings 21 and the retaining spring 36 are highly elastic while the bridge 8 is quite massive and supported by fulcrum screws 40 which do not impede the rocking motions of the bridge 8 to a significant degree. Such an arrangement of parts creates a frequency of resonance at which the entire tremolo-bridge 8 tends to vibrate in an undamped manner, about a center position, whenever a string 21 is plucked and when any portion of the bridge 8 is struck or otherwise disturbed. The position of the arm 39 influences the bridge resonant frequency and if the arm 39 is loosely coupled to the bridge plate 38, the bridge resonant frequency may change in an unpredictable manner within limits and a variety of shock vibrations may also be created in the bridge 8 and transmitted to the transducer supporting portion of each string anchoring block 41.

These undesirable bridge vibrations cause corresponding changes in the tension of the strings 21 which in turn affect both transducers 10 and 11 of each pickup 9. The transducer supporting portion of the string anchoring block 41 is constructed so that the first transducer 10 is positioned for best response to the desirable string vibrations while the position of the second transducer 11 is optimized for complete cancellation of the undesirable bridge vibrations in the joint signal of each pickup 9.

The specific elements of the transducers 10 and 11 along with the means to connect them to obtain a joint signal and means to connect the joint signal to utilisation means have been omitted for clarity. The joint signal of the pickup 9 may be obtained either by connecting out-of-phase transducers 10 and 11 together, in a manner similar to that of the arrangement of FIGS. 1–3, or by using electrical circuitry to mix the signals from the transducers 10 and 11 of each pickup 9. Depending on the components present therein, it may be desirable to filter the signal from the second transducer 11 prior to mixing it with the signal from the first transducer 10 in order to simultaneously optimize the cancellation of undesirable string vibrations and the sound quality of the pickup 9. It may also be desirable to use non-linear functions, such as logarithmic or anti-log amplifier functions, to correct the response of the second transducer 11 to the undesirable vibrations in order to achieve the desired cancellation of these undesirable vibrations.

Figure 6:
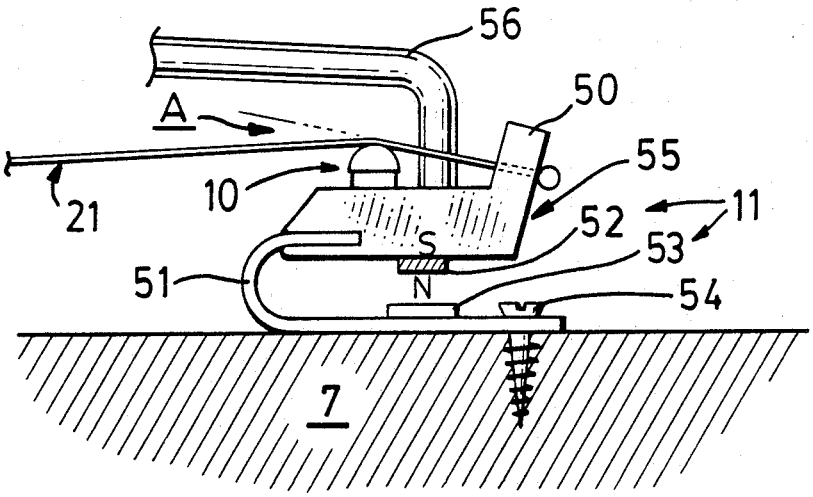
FIG. 6 is a side view of a third embodiment of the present invention in the tremolo-bridge of a solid-body bass guitar.

FIG. 6 illustrates a third embodiment of the present invention in a tremolo-bridge 55. In this embodiment, the first transducer 10 monitors the desirable vibrations of the vibrating portion 22 of the string 21 while the motions of the bridge 50 are monitored by the second transducer 11 which, in this embodiment, is composed of a Hall-effect device 53 sensitive to the position of a magnet 52 fixed to the underside of the bridge span 50. The string 21 is anchored in a raised portion of the bridge span 50. A leaf spring 51 maintains the bridge 55 in a centered position, opposing the tension of the strings 21. The leaf spring 51 is maintained solidary of the body 7 of the instrument by the retaining screw 54. Since the bridge span 50 is quite massive, the second transducer 11 is not significantly subjected to the desirable vibrations of the string 21.

The break-angle A made over the first transducer 10 by the string 21 renders the transducer 10 sensitive to changes in the string's 21 tension. Because of the compliance of the leaf spring 51, the position of the bridge 55 is determined by the magnitude of the string 21 tension. The field induced by the magnet 52 through the Hall-effect device 53 varies as the inverse square function of the distance separating them. The second transducer 11 therefore responds in a non-linear manner to the changes in the tension of the string 21. Since the first transducer 10 responds linearly to the string 21 tension changes while the second transducer 11 responds in a non-linear manner to the corresponding movements of the bridge 55, it is preferable to linearize the response of the second transducer 11 so that the cancellation of the undesirable effects of the bridge movements may be achieved in the joint signal.

Figure 7:
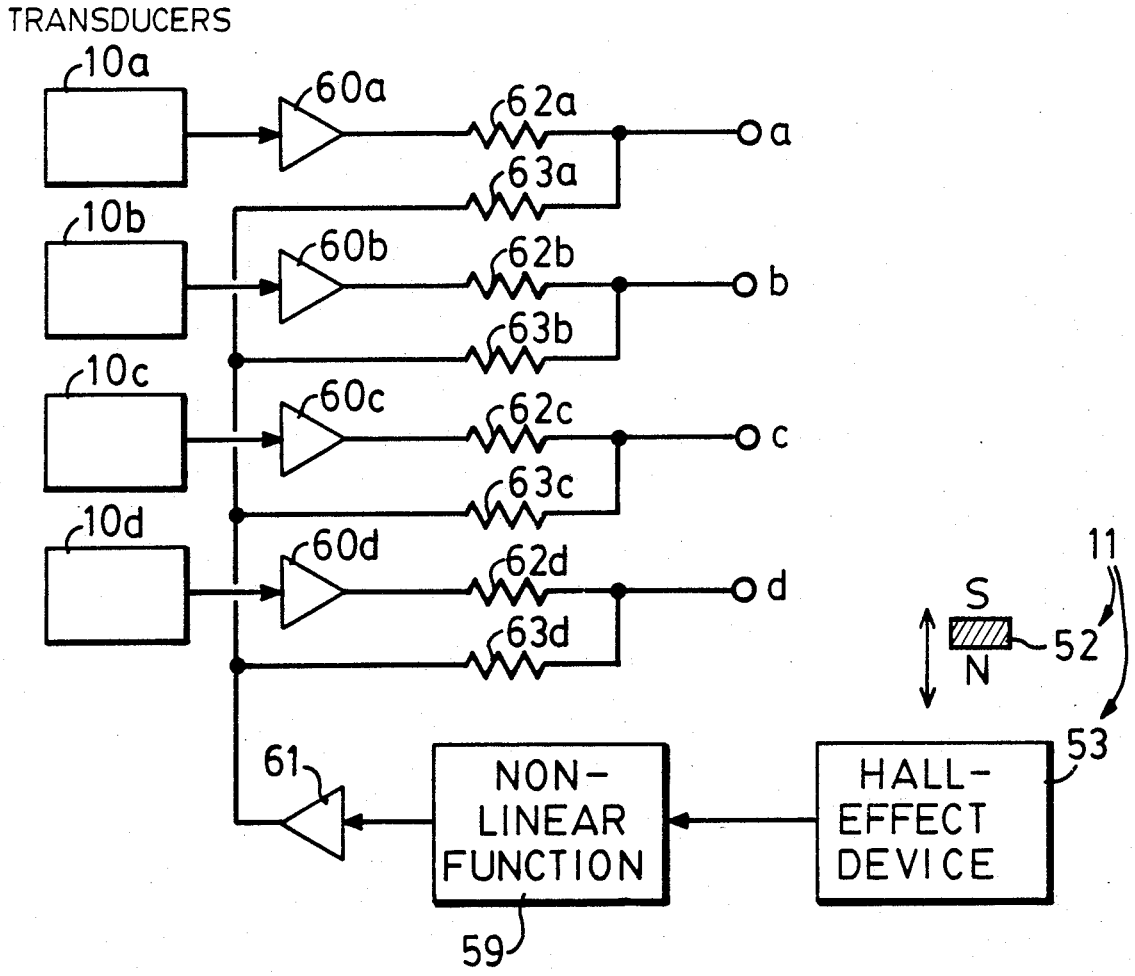
FIG. 7 is an electrical diagram of the embodiment of FIG. 6, including signal combining means.

FIG. 7 is an electrical diagram of the signal combining means used to achieve the desired cancellation of the undesirable effects of the bridge movements in the separate string signals from a plurality of first transducers **10*a*–10*d* mounted on the tremolo-bridge 55 of a bass guitar. A non-linear function network 59 is used to modify the signal from the Hall-effect device 53 and make its magnitude proportional to the tension of the string 21. In this manner, when the linearized signal from the second transducer 11 is mixed with the signal from the transducers 10*a*–10*d*, the undesirable effects of the movements of the bridge 55 present in the separate signals from the first transducers 10*a*–10*d* will be significantly reduced and possibly cancelled in the joint signals "a–d". A plurality of first transducers 10*a*–10*d* are respectively buffered by amplifiers 60*a*–60*d*, the outputs of which are respectively connected to resistors 62*a*–62*d*. The linearized signal from the second transducer 11 appearing at the output of the driver amplifier 61 is split four ways by resistors 63*a*–63*d*. The resistors 62*a*–62*d* and 63*a*–63*d* are respectively connected in pairs to produce joint signals "a–d". Other types of transducer signal mixing means are also possible; a potentiometer may be used in place of a pair of resistors 62 and 63 or time domain mixing may be performed using multiplexers to obtain serial data in which each pair of time slots contain the joint signal and the entire serial data stream is a mono signal and the individual signals from the transducers 10*a*–10*d* and 11 are still available for further processing. Since the second transducer 11 is not significantly subjected to the desirable vibrations of the strings 21**, it does not cause a significant increase in string-to-string crosstalk and the separate joint signals "a–d" are not mixed together in the cancellation process. This is very important when the pickup signals "a–d" are to be used in conjunction with fundamental frequency extraction devices such as octave dividers and instrument-to-synthesizer interfaces, in multi-rack recording of the instrument or in any other application where it is desirable to maintain a high degree of separation between the string signals.

By applying the teachings of the present invention, it is possible to reduce the magnitude of a type of proximity effect typical of string contacting transducers which becomes very apparent in the transducer signal whenever a string is stimulated near the transducer. Most of the transient in the transducer signal resulting from stimulating a string near a bridge transducer is caused by a rapid change in the tension of the contacting string. Since the present invention teaches a pickup in which the sensitivity to changes in the string tension may be significantly reduced and possibly eliminated, the proximity effect mentioned above is consequently reduced and possibly virtually eliminated in a pickup according to the present invention.

Figure 8:
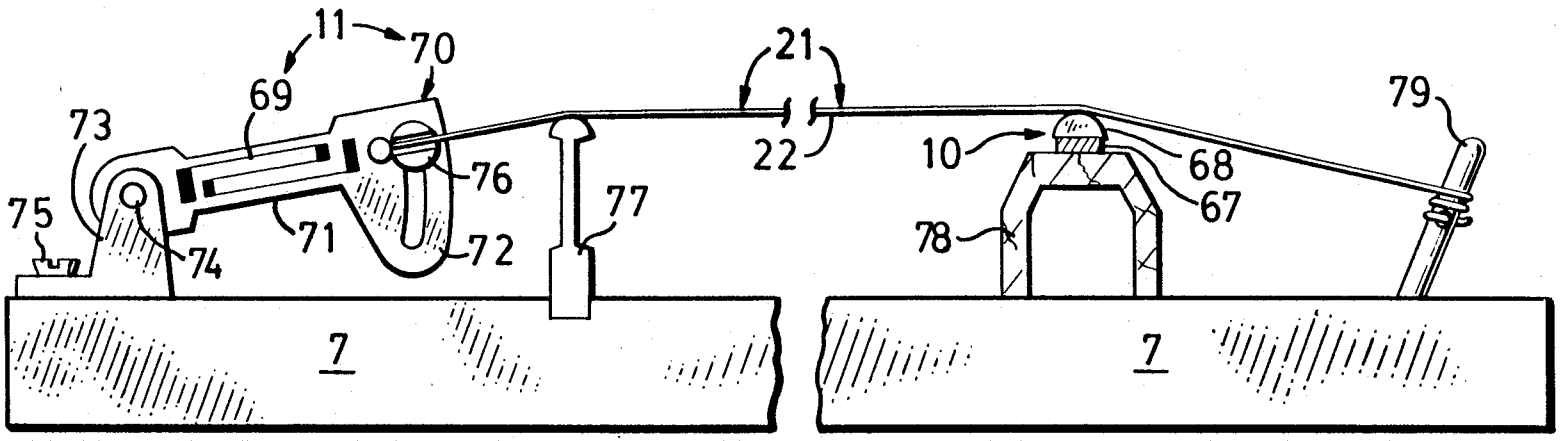
FIG. 8 is a side view of a fourth embodiment of the present invention in a generic stringed instrument.

Referring now to FIG. 8, a fourth embodiment of the present invention is illustrated in which a bridge 78 rests on the body 7 of a generic stringed instrument. The bridge 78 supports a first transducer 10 composed of a piezoelectric element 67 supporting a string support 68 in contact with the string 21. The first transducer monitors the desirable vibrations of the vibrating portion 22 of the string 21. The string 21 is anchored at a first end by a tuning pin 79 sunk in the body 7 of the instrument. The string 21 also passes over a second bridge 77 (which may be the nut of the instrument) and is anchored at the other end by a string anchoring post 76 solidary of the second transducer 11. In this embodiment, the second transducer 11 is a strain gauge 69 under tension located on an extensible portion 71 of a transducer support plate 70. The string anchoring portion 72 of the transducer supporting plate 70 is slotted to provide orientation adjustment for the strain gauge 69 and thus allow the sensitivity of the second transducer 11 to be adjusted. The transducer supporting plate 70 is rotatably fixed to the body 7 of the instrument by a retaining pin 74 held in a retaining block 73 solidary of the body 7 of the instrument. The retaining block 73 is fixed to the body 7 by means of a securing screw 75.

Since the strain gauge 69 is distended virtually only by changes in the tension of the string 21, it is not subjected to the desirable vibrations of the vibrating portion 22 of the string 21. It is preferable that the second bridge 77 be slightly flexible or posses some other feature that will help to reduce the friction between the second bridge 77 and the string 21 since such friction may impede the accurate operation of the second transducer 11. The second bridge 77 is preferably incompressible in the direction of the desirable string vibrations and preferably has a hard string contacting surface. It is also desirable that the portion of the instrument supporting the first transducer 10 have some compliance in the direction of the applied string tension for the same minimum impediment purpose. The portion of the instrument (here, the bridge 78) supporting the first transducer 10 may either be slightly displaced or deformed in the direction of the string tension as a result of a change in the applied tension. This feature helps the operation of the second transducer 11. The portion of the instrument (here, the bridge 78) supporting the first transducer 10 should also remain inflexible and incompressible in the direction of the desirable string vibrations.

These friction reducing features apply equally well to other embodiments of the present invention since the second transducer 11 can most accurately respond to changes in the string tension when no string 21 to instrument friction is present at points other than the anchoring points of the string 21. Accordingly, by means of example, in a guitar or similar instrument, a roller nut may be used to reduce the nut-to-string friction irrespectively of the location of the transducers 10 or 11.

Figure 9:
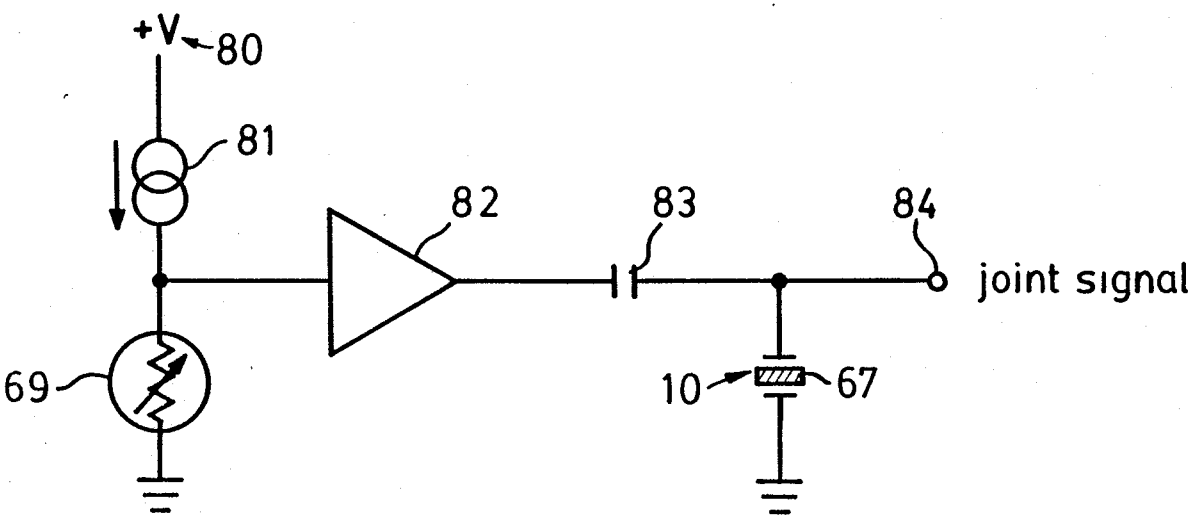
FIG. 9 is an electrical diagram of the embodiment of FIG. 8, including signal combining means.

FIG. 9 illustrates the signal combining means used in this fourth embodiment of the present invention. The electrical resistance of the strain gauge 69 varies as a function of the magnitude of the tension in the string 21. A current source 81 drawing from a power supply 80 biases the resistive strain gauge so that the voltage appearing at the junction of the current source 81 and the strain gauge 69 will be approximately proportional to the tension in the string 21. The voltage changes caused by the resistance changes of the biased strain gauge are amplified by a voltage amplifier 82, the output of which is connected to the first transducer 10 via a capacitor 83 in order to simulate a capacitive second transducer. This is preferable since the signal generating element of the first transducer 10 is a piezoelectric element 67 which is capacitive in nature.

A noise-free joint signal appears at the output terminal 84 of the pickup which is the junction between the first transducer 10 and the capacitor 83 carrying the signal from the second transducer 11.

Still other variations of the present invention will suggest themselves to persons of ordinary skill in the art. It is intended therefore that the foregoing description be considered as exemplary only and that the scope of the invention be ascertained by the following claims.

What is claimed is:

1. A pickup for a vibratable string under tension of a musical instrument, said vibratable string under said tension having a vibrating first portion and a less vibrating second portion, said pickup comprising:

first transducer means responsive to vibrations of said vibratable string and responsive to variations of said tension of said vibratable string and producing a first transducer signal minimally comprising a first component caused by a vibration of said first portion of said vibratable string and a second component caused by a variation of said tension of said vibratable string, second transducer means responsive to said variation of said tension of said vibratable string, effectively less responsive to said vibrations of said vibrating portion of said vibratable string than said first transducer means, and producing a second transducer signal minimally comprising a third component caused by said variation of said tension of said vibratable string and corresponding to said second component of said first transducer signal, and means to combine said first and said second transducer signals and produce a joint transducer signal therefrom, whereby said pickup has a selectively reduced sensitivity to said variation of said tension of said vibratable string in said joint transducer signal.

2. The pickup of claim 1 wherein said second component of said first transducer signal and said third component of said second transducer signal are effectively cancelled in said joint transducer signal.

3. The pickup of claim 1 wherein said first and said second transducer means have approximately equal sensitivity to said variations of said tension of said vibratable string.

4. The pickup of claim 1 wherein said first and said second transducer means produce out of phase said second and said third components in response to a said variation of said tension of said vibratable string.

5. The pickup of claim 1 wherein said second transducer means has an adjustable sensitivity to said variations of said tension of said vibratable string.

6. The pickup of claim 5 wherein said adjustable sensitivity is provided by means to adjust an angle made by said vibratable string with respect to a said transducer means.

7. The pickup of claim 5 wherein said adjustable sensitivity is provided by orientation adjustment means for said second transducer means.

8. The pickup of claim 1 wherein a said transducer means is subjected to a tension applied by means of said vibratable string.

9. The pickup of claim 1 wherein a said component of a said transducer signal has a magnitude which is a function of the magnitude of said tension of said vibratable string.

10. The pickup of claim 1 further comprising resilient means to apply a variable tension to said vibratable string.

11. The pickup of claim 1 further comprising means to anchor an end of said vibratable string next to a said transducer means.

12. The pickup of claim 1 wherein said second transducer means is responsive to movements of a moveable portion of said instrument, other than said vibrating first portion of said vibratable string, wherein a said movement occurs in connection with a said variation of said tension of said vibratable string.

13. The pickup of claim 12 wherein said second transducer means produces a signal indicative of a position of said moveable portion of said instrument with respect to a fixed portion thereof.

14. The pickup of claim 1 wherein said second transducer means is responsive to a force having a magnitude which is a function of said tension of the magnitude of said vibratable string.

15. The pickup of claim 1 wherein said means to combine said first and said second transducer signals comprise signal modifying means for said second transducer signal.

16. The pickup of claim 15 wherein said signal modifying means comprise signal filtering means.

17. The pickup of claim 1 further comprising means to reduce friction between said vibratable string and a portion of said instrument contacted by said vibratable string and other than means to anchor an end of said vibratable string to said musical instrument.

18. The pickup of claim 1, further comprising means to reduce a shear force exerted by said vibratable string on a said transducer means.

19. The pickup of claim 18 wherein said first transducer means contacts said vibrating first portion and said less vibrating second portion of said vibratable string under said tension and wherein said second transducer means contacts said less vibrating second portion of said vibratable string under said tension.

* * * * *